US007875787B2

(12) United States Patent
Lemons

(10) Patent No.: US 7,875,787 B2
(45) Date of Patent: Jan. 25, 2011

(54) APPARATUS AND METHOD FOR VISUALIZATION OF MUSIC USING NOTE EXTRACTION

(75) Inventor: Kenneth R. Lemons, Indianapolis, IN (US)

(73) Assignee: Master Key, LLC, Indianapolis, IN (US)

( * ) Notice: Subject to any disclaimer, the term of this patent is extended or adjusted under 35 U.S.C. 154(b) by 166 days.

(21) Appl. No.: 12/322,482

(22) Filed: Feb. 2, 2009

(65) Prior Publication Data

US 2009/0223348 A1 Sep. 10, 2009

Related U.S. Application Data

(60) Provisional application No. 61/025,374, filed on Feb. 1, 2008.

(51) Int. Cl.
*G10D 13/02* (2006.01)

(52) U.S. Cl. ..... 84/483.2; 84/477 R; 84/483.1; 84/609; 84/649

(58) Field of Classification Search ..... None
See application file for complete search history.

(56) References Cited

U.S. PATENT DOCUMENTS

| | | | |
|---|---|---|---|
| 2,804,500 | A | 8/1957 | Giacoletto |
| 3,969,972 | A | 7/1976 | Bryant |
| 4,128,846 | A | 12/1978 | Robinson, Jr. |
| 4,172,406 | A | 10/1979 | Martinez |
| 4,257,062 | A | 3/1981 | Meredith |
| 4,378,466 | A | 3/1983 | Esser |
| 4,526,168 | A | 7/1985 | Hassler et al. |
| 4,887,507 | A | 12/1989 | Shaw |
| 4,907,573 | A | 3/1990 | Nagasaki |

(Continued)

FOREIGN PATENT DOCUMENTS

| | | | |
|---|---|---|---|
| EP | 0349686 | A1 | 1/1990 |

(Continued)

OTHER PUBLICATIONS

"Time-line of the Music Animation Machine (and related experiments)", Music Animation Machine: HIstory, htp://www.musanim.com/mam/mamhist.htm, pp. 1-5, p. 1, pp. 1-2, pp. 1-2 & p. 1, printed Aug. 30, 2007.

(Continued)

*Primary Examiner*—Marlon T Fletcher
(74) *Attorney, Agent, or Firm*—Woodard, Emhardt, Moriarty, McNett & Henry LLP

(57) ABSTRACT

The present disclosure relates to a system and method for visualization of music and other sounds using note extraction. In one embodiment, the twelve notes of an octave are labeled around a circle. Raw audio information is fed into the system, whereby the system applies note extraction techniques to isolate the musical notes in a particular passage. The intervals between the notes are then visualized by displaying a line between the labels corresponding to the note labels on the circle. In some embodiments, the lines representing the intervals are color coded with a different color for each of the six intervals. In other embodiments, the music and other sounds are visualized upon a helix that allows an indication of absolute frequency to be displayed for each note or sound.

1 Claim, 16 Drawing Sheets
(11 of 16 Drawing Sheet(s) Filed in Color)

U.S. PATENT DOCUMENTS

| | | | | |
|---|---|---|---|---|
| 5,048,390 | A | 9/1991 | Adachi et al. | |
| 5,207,214 | A | 5/1993 | Romano | |
| 5,370,539 | A | 12/1994 | Dillard | |
| 5,415,071 | A | 5/1995 | Davies | |
| 5,563,358 | A | 10/1996 | Zimmerman | |
| 5,741,990 | A | 4/1998 | Davies | |
| 5,784,096 | A | 7/1998 | Paist | |
| 6,031,172 | A | 2/2000 | Papadopoulos | |
| 6,111,755 | A | 8/2000 | Park | |
| 6,127,616 | A | 10/2000 | Yu | |
| 6,137,041 | A | 10/2000 | Nakano | |
| 6,201,769 | B1 | 3/2001 | Lewis | |
| 6,245,981 | B1 | 6/2001 | Smith | |
| 6,350,942 | B1 | 2/2002 | Thomson | |
| 6,390,923 | B1 | 5/2002 | Yoshitomi et al. | |
| 6,392,131 | B2 * | 5/2002 | Boyer | 84/424 |
| 6,411,289 | B1 | 6/2002 | Zimmerman | |
| 6,448,487 | B1 | 9/2002 | Smith | |
| 6,686,529 | B2 | 2/2004 | Kim | |
| 6,750,386 | B2 | 6/2004 | King | |
| 6,791,568 | B2 | 9/2004 | Steinberg et al. | |
| 6,856,329 | B1 | 2/2005 | Peevers et al. | |
| 6,927,331 | B2 | 8/2005 | Haase | |
| 6,930,235 | B2 | 8/2005 | Sandborn et al. | |
| 7,030,307 | B2 | 4/2006 | Wedel | |
| 7,096,154 | B1 | 8/2006 | Andrade-Cetto | |
| 7,153,139 | B2 | 12/2006 | Wen et al. | |
| 7,182,601 | B2 | 2/2007 | Donnan | |
| 7,212,213 | B2 | 5/2007 | Steinberg et al. | |
| 7,271,329 | B2 | 9/2007 | Franzblau | |
| 7,400,361 | B2 | 7/2008 | Noske et al. | |
| 7,667,125 | B2 * | 2/2010 | Taub et al. | 84/616 |
| 7,714,222 | B2 * | 5/2010 | Taub et al. | 84/600 |
| 2003/0205124 | A1 | 11/2003 | Foote et al. | |
| 2004/0206225 | A1 | 10/2004 | Wedel | |
| 2005/0190199 | A1 | 9/2005 | Brown et al. | |
| 2005/0241465 | A1 | 11/2005 | Goto | |
| 2007/0044639 | A1 | 3/2007 | Farbood et al. | |
| 2007/0157795 | A1 | 7/2007 | Hung | |
| 2007/0180979 | A1 | 8/2007 | Rosenberg | |
| 2008/0022642 | A1 | 1/2008 | Lemons | |
| 2008/0034947 | A1 * | 2/2008 | Sumita | 84/613 |
| 2008/0115656 | A1 * | 5/2008 | Sumita | 84/612 |
| 2008/0190271 | A1 * | 8/2008 | Taub et al. | 84/645 |
| 2008/0264239 | A1 | 10/2008 | Lemons et al. | |
| 2008/0271589 | A1 | 11/2008 | Lemons | |
| 2008/0271590 | A1 | 11/2008 | Lemons | |
| 2008/0271591 | A1 * | 11/2008 | Lemons | 84/601 |
| 2008/0276790 | A1 | 11/2008 | Lemons | |
| 2008/0276791 | A1 * | 11/2008 | Lemons | 84/483.2 |
| 2008/0276793 | A1 * | 11/2008 | Yamashita et al. | 84/611 |
| 2008/0314228 | A1 | 12/2008 | Dreyfuss et al. | |
| 2009/0223348 | A1 * | 9/2009 | Lemons | 84/483.2 |
| 2010/0154619 | A1 * | 6/2010 | Taub et al. | 84/616 |

FOREIGN PATENT DOCUMENTS

| | | | |
|---|---|---|---|
| EP | 456 860 | A1 | 11/1991 |
| EP | 1354561 | A1 | 10/2003 |
| JP | 05-232856 | | 9/1993 |
| JP | 2004-226556 | A | 8/2004 |
| KR | 10-2006-0110988 | | 10/2006 |

OTHER PUBLICATIONS

Ashton, Anthony, "Harmonograph: A Visual Guide to the Mathematics of Music," ISBN 0-8027-1409-9, Walker Publishing Company, 2003, pp. 1-58.

Bourke, Paul, "Harmonograph," Aug. 1999, http://local.wasp.uwa.edu.au/~pbourke/suraces_curves/harmonograph/, pp. 1-6, printed Aug. 30, 2007.

Dunne, Gabriel, "Color/Shape/Sound Ratio & Symmetry Calculator", Quilime.com—Symmetry Calculator, https://www.quilime.com/conent/colorcalc/, pp. 1-6, printed Jul. 3, 2007.

Notification of Transmittal International Preliminary Report on Patentability for International Application No. PCT/US07/15822, dated Oct. 23, 2008.

Patent Application Search Report mailed on Aug. 1, 2008 for PCT/US2008/59126.

Patent Application Search Report mailed on Aug. 14, 2008 for PCT/US2008/004989.

Patent Application Search Report mailed on Aug. 18, 2008 for PCT/US2008/005069.

Patent Application Search Report mailed on Aug. 18, 2008 for PCT/US2008/005073.

Patent Application Search Report mailed on Aug. 18, 2008 for PCT/US2008/005126.

Patent Application Search Report mailed on Aug. 21, 2008 for PCT/US2008/005076.

Patent Application Search Report mailed on Aug. 27, 2008 for PCT/US2008/5075.

Patent Application Search Report mailed on Aug. 28, 2008 for PCT/US2008/005077.

Patent Application Search Report mailed on Jul. 31, 2008 for PCT/US2008/005070.

Patent Application Search Report mailed on Sep. 18, 2008 for PCT/US2008/005072.

Patent Application Search Report mailed on Sep. 18, 2008 for PCT/US2008/005124.

Patent Application Search Report mailed on Sep. 24, 2008 for PCT/US2008/005125.

Patent Application search Report mailed on Sep. 29, 2008 for PCT/US2008/005074.

Rabiner, Huang, "Fundamentals of Speech Recognition," PTR Prentice Hall, Inc., 1993, ISBN 0-13-285826-6, pp. 21-31; 42-68 and Fig. 2.17, 2.32.

Patent Application Search Report mailed on Aug. 25, 2009 for PCT/US2009/000684.

Written Opinion mailed on Aug. 25, 2009 for PCT/US2009/00684.

* cited by examiner

APPARATUS AND METHOD FOR VISUALIZATION OF MUSIC USING NOTE EXTRACTION

CROSS-REFERENCE TO RELATED APPLICATIONS

The present application claims the benefit of U.S. Provisional Application Ser. No. 61/025,374 filed Feb. 1, 2008 entitled "Apparatus and Method for Visualization of Music Using Note Extraction" which is hereby incorporated by reference in its entirety. The present application is also related to U.S. Provisional Patent Application Ser. No. 60/830,386 filed Jul. 12, 2006 entitled "Apparatus and Method for Visualizing Musical Notation" and U.S. Provisional Patent Application Ser. No. 60/921,578 filed Apr. 3, 2007 entitled "Device and Method for Visualizing Musical Rhythmic Structures". This application is also related to U.S. Utility patent application Ser. No. 11/827,264 filed Jul. 11, 2007 entitled "Apparatus and Method for Visualizing Music and Other Sounds" and U.S. Utility patent application Ser. No. 12/023,375 entitled "Device and Method for Visualizing Musical Rhythmic Structures" filed Jan. 31, 2008. All of these applications are hereby incorporated by reference in their entirety.

TECHNICAL FIELD OF THE DISCLOSURE

The present disclosure generally relates to sound analysis and, more specifically, to an apparatus and method for visualizing music and other sounds using note extraction.

BACKGROUND AND SUMMARY

The above referenced applications describe methods for visualizing tonal and rhythmic music structures. There is a need, however, for a method of applying these techniques to prerecorded or live music so that the individual note information can then be visualized for a user.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE VARIOUS EMBODIMENTS

Before describing the note extraction apparatus and method, a summary of the above-referenced music tonal and rhythmic visualization methods will be presented. The tonal visualization methods are described in U.S. patent application Ser. No. 11/827,264 filed Jul. 11, 2007 entitled "Apparatus and Method for Visualizing Music and Other Sounds" which is hereby incorporated by reference.

There are three traditional scales or 'patterns' of musical tone that have developed over the centuries. These three scales, each made up of seven notes, have become the foundation for virtually all musical education in the modern world. There are, of course, other scales, and it is possible to create any arbitrary pattern of notes that one may desire; but the vast majority of musical sound can still be traced back to these three primary scales.

Each of the three main scales is a lopsided conglomeration of seven intervals:

Major scale: 2 steps, 2 steps, 1 step, 2 steps, 2 steps, 2 steps, 1 step

Harmonic Minor Scale: 2, 1, 2, 2, 1, 3, 1

Melodic Minor Scale: 2, 1, 2, 2, 2, 2, 1

Unfortunately, our traditional musical notation system has also been based upon the use of seven letters (or note names) to correspond with the seven notes of the scale: A, B, C, D, E, F and G. The problem is that, depending on which of the three scales one is using, there are actually twelve possible tones to choose from in the 'pool' of notes used by the three scales. Because of this discrepancy, the traditional system of musical notation has been inherently lopsided at its root.

With a circle of twelve tones and only seven note names, there are (of course) five missing note names. To compensate, the traditional system of music notation uses a somewhat arbitrary system of 'sharps' (#'s) and 'flats' (b's) to cover the remaining five tones so that a single notation system can be used to encompass all three scales. For example, certain key signatures will have seven 'pure letter' tones (like 'A') in addition to sharp or flat tones (like $C^{\#}$ or $G^{b}$), depending on the key signature. This leads to a complex system of reading and writing notes on a staff, where one has to mentally juggle a key signature with various accidentals (sharps and flats) that are then added one note at a time. The result is that the seven-note scale, which is a lopsided entity, is presented as a straight line on the traditional musical notation staff. On the other hand, truly symmetrical patterns (such as the chromatic scale) are represented in a lopsided manner on the traditional musical staff. All of this inefficiency stems from the inherent flaw of the traditional written system being based upon the seven note scales instead of the twelve-tone circle.

Figure 1:
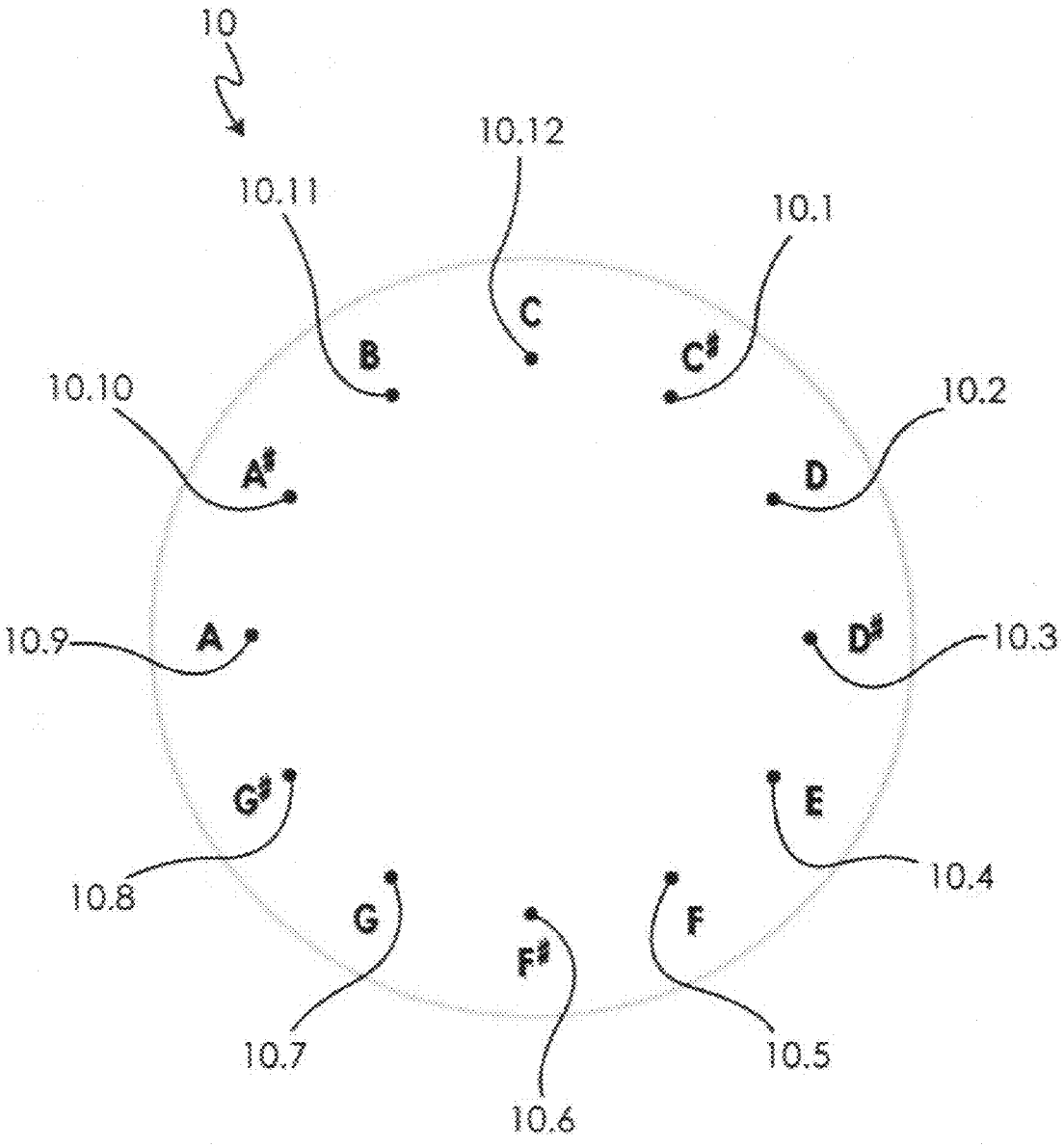
FIG. 1 is a diagram of a twelve-tone circle according to one embodiment.

To overcome this inefficiency, a set of mathematically based, color-coded MASTER KEY™ diagrams is presented to better explain the theory and structures of music using geometric form and the color spectrum. As shown in FIG. 1, the twelve tone circle 10 is the template upon which all of the other diagrams are built. Twelve points 10.1-10.12 are geometrically placed in equal intervals around the perimeter of the circle 10 in the manner of a clock; twelve points, each thirty degrees apart. Each of the points 10.1-10.12 on the circle 10 represents one of the twelve pitches. The names of the various pitches can then be plotted around the circle 10. It will be appreciated that in traditional musical notation there are more than one name for each pitch (e.g., $A^{\#}$ is the same as $B^{b}$), which causes inefficiency and confusion since each note can be 'spelled' in two different ways. In the illustrated embodiment, the circle 10 has retained these traditional labels, although the present disclosure comprehends that alternative labels can be used, such as the letters A-L, or numbers 1-12. Furthermore, the circle 10 of FIG. 1 uses the sharp notes as labels; however, it will be understood that some or all of these sharp notes can be labeled with their flat equivalents and that some of the non-sharp and non-flat notes can be labeled with the sharp or flat equivalents.

Figure 2:
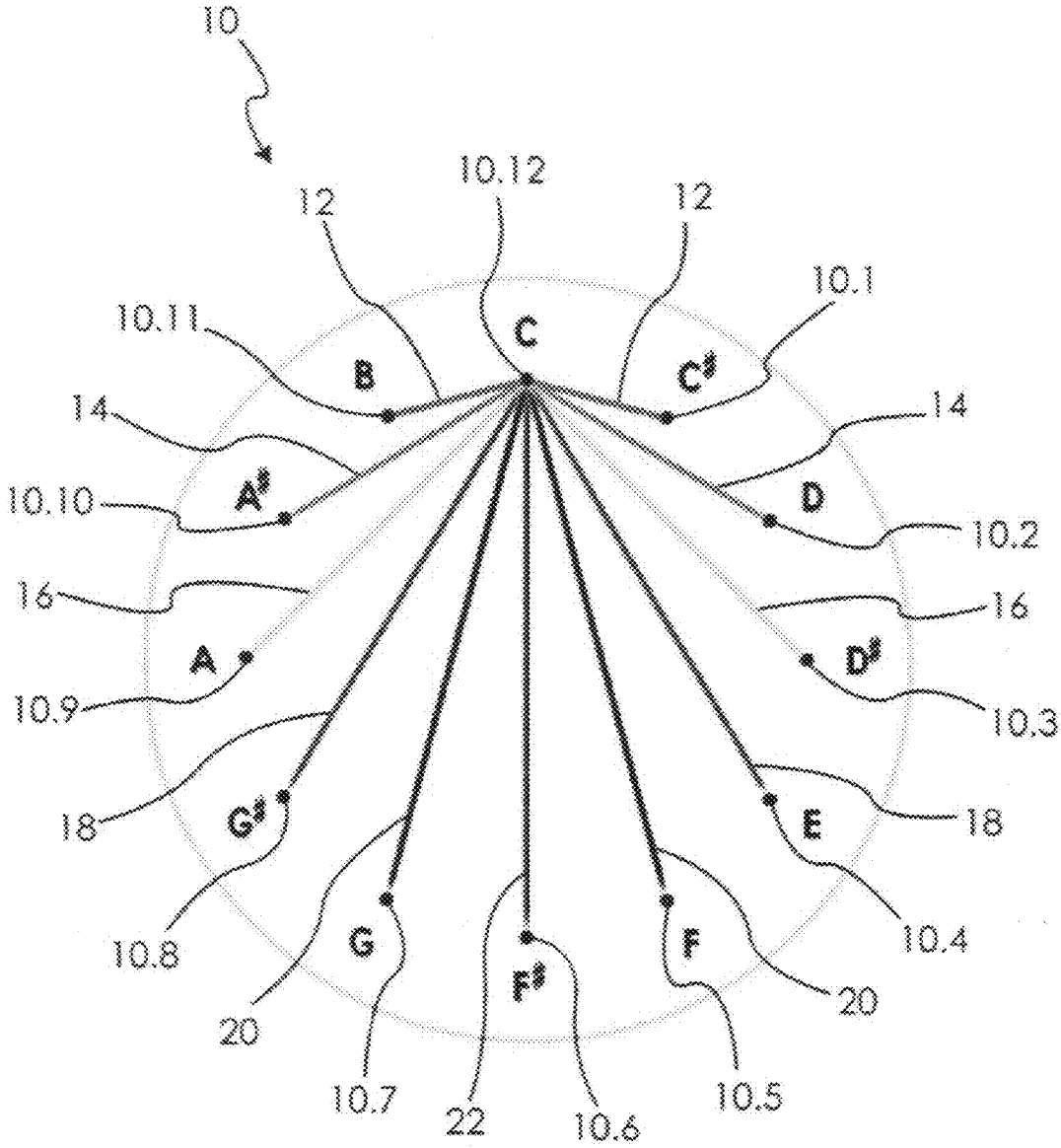
FIG. 2 is a diagram of a twelve-tone circle showing the six intervals.

The next 'generation' of the MASTER KEY™ diagrams involves thinking in terms of two note 'intervals.' The Interval diagram, shown in FIG. 2, is the second of the MASTER KEY™ diagrams, and is formed by connecting the top point 10.12 of the twelve-tone circle 10 to every other point 10.1-10.11. The ensuing lines-their relative length and color-represent the various 'intervals.' It shall be understood that while eleven intervals are illustrated in FIG. 2, there are actually only six basic intervals to consider. This is because any interval larger than the tri-tone (displayed in purple in FIG. 2) has a 'mirror' interval on the opposite side of the circle. For example, the whole-step interval between C (point 10.12) and D (point 10.2) is equal to that between C (point 10.12) and $A^{\#}$ (point 10.10).

Another important aspect of the MASTER KEY™ diagrams is the use of color. Because there are six basic music intervals, the six basic colors of the rainbow can be used to provide another way to comprehend the basic structures of music. In a preferred embodiment, the interval line 12 for a half step is colored red, the interval line 14 for a whole step is colored orange, the interval line 16 for a minor third is colored yellow, the interval line 18 for a major third is colored green, the interval line 20 for a perfect fourth is colored blue, and the interval line 22 for a tri-tone is colored purple. In other embodiments, different color schemes may be employed. What is desirable is that there is a gradated color spectrum assigned to the intervals so that they may be distinguished from one another by the use of color, which the human eye can detect and process very quickly.

Figure 3:
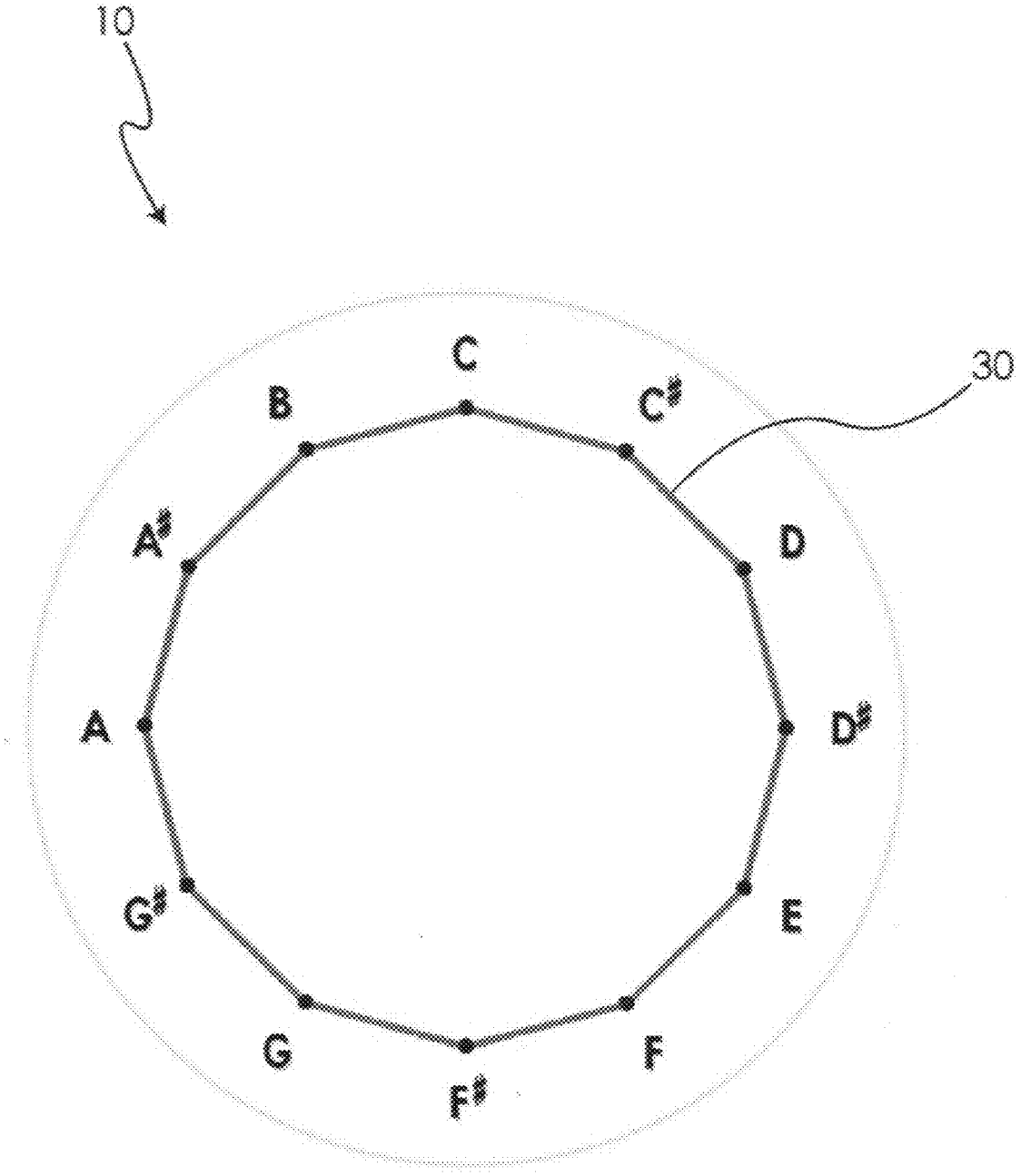
FIG. 3 is a diagram of a twelve-tone circle showing the chromatic scale.
Figure 4:
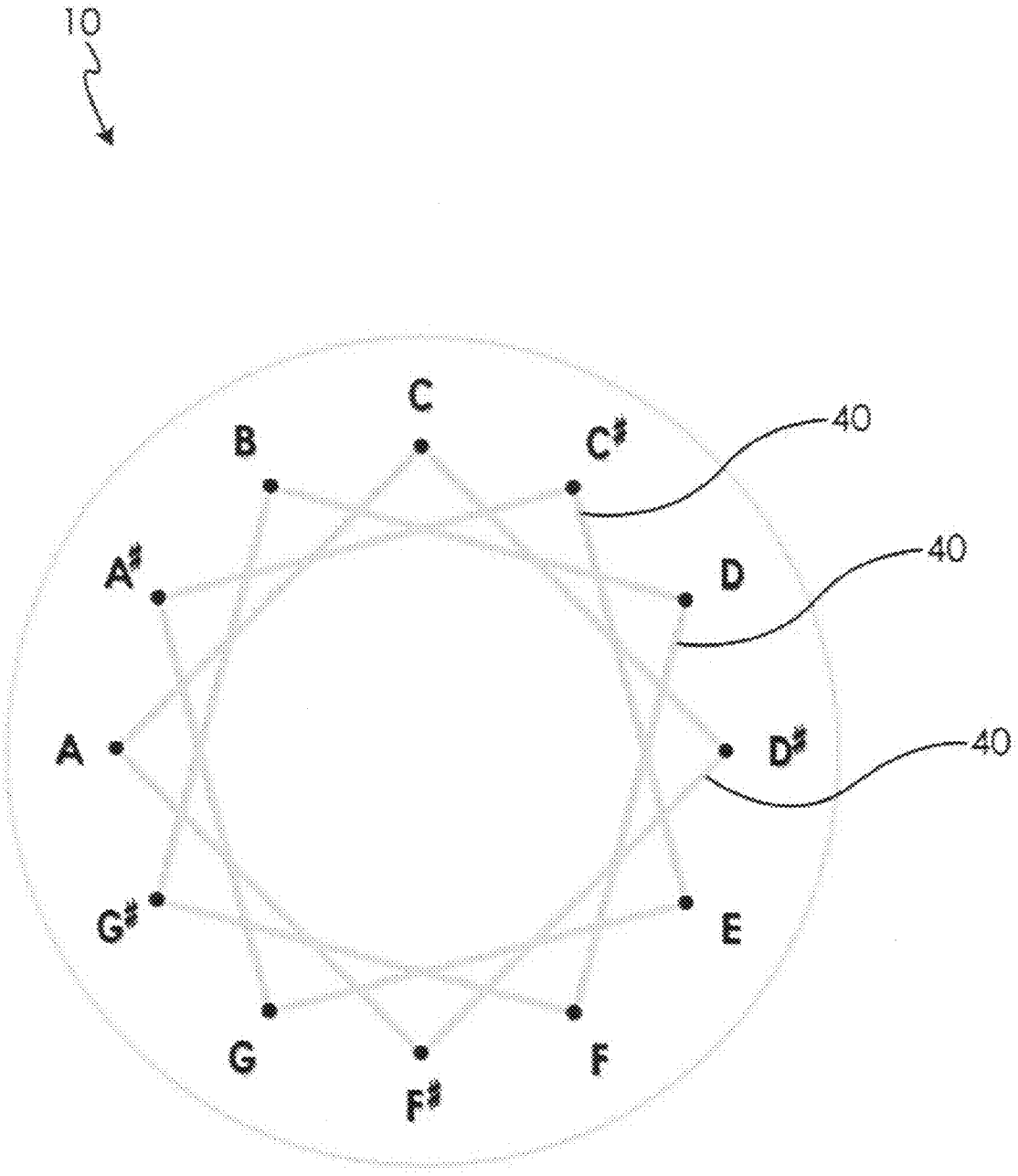
FIG. 4 is a diagram of a twelve-tone circle showing the first through third diminished scales.
Figure 5:
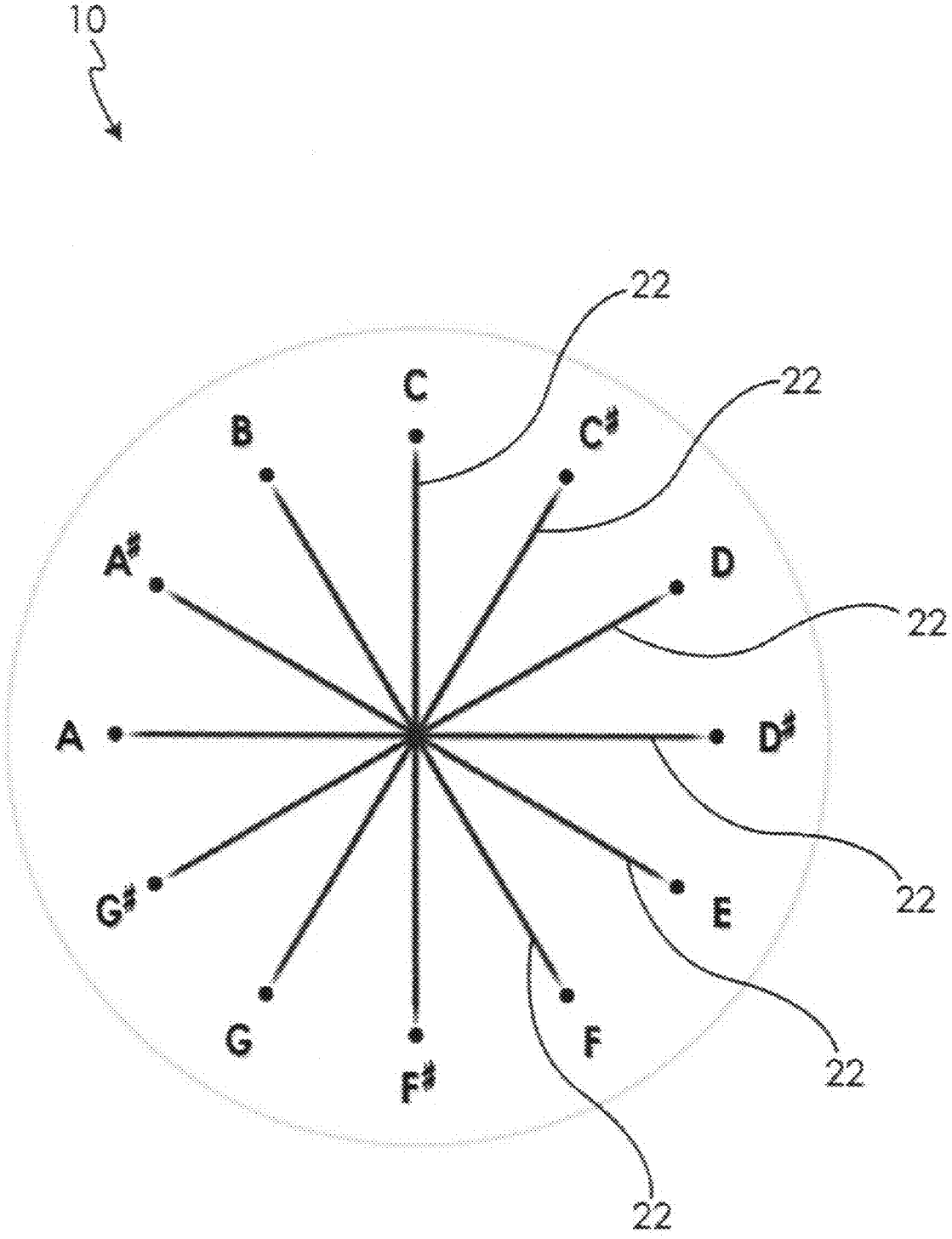
FIG. 5 is a diagram of a twelve-tone circle showing all six tri-tones.

The next group of MASTER KEY™ diagrams pertains to extending the various intervals 12-22 to their completion around the twelve-tone circle 10. This concept is illustrated in FIG. 3, which is the diagram of the chromatic scale. In these diagrams, each interval is the same color since all of the intervals are equal (in this case, a half-step). In the larger intervals, only a subset of the available tones is used to complete one trip around the circle. For example, the minor-third scale, which gives the sound of a diminished scale and forms the shape of a square 40, requires three transposed scales to fill all of the available tones, as illustrated in FIG. 4. The largest interval, the tri-tone, actually remains a two-note shape 22, with six intervals needed to complete the circle, as shown in FIG. 5.

Figure 6:
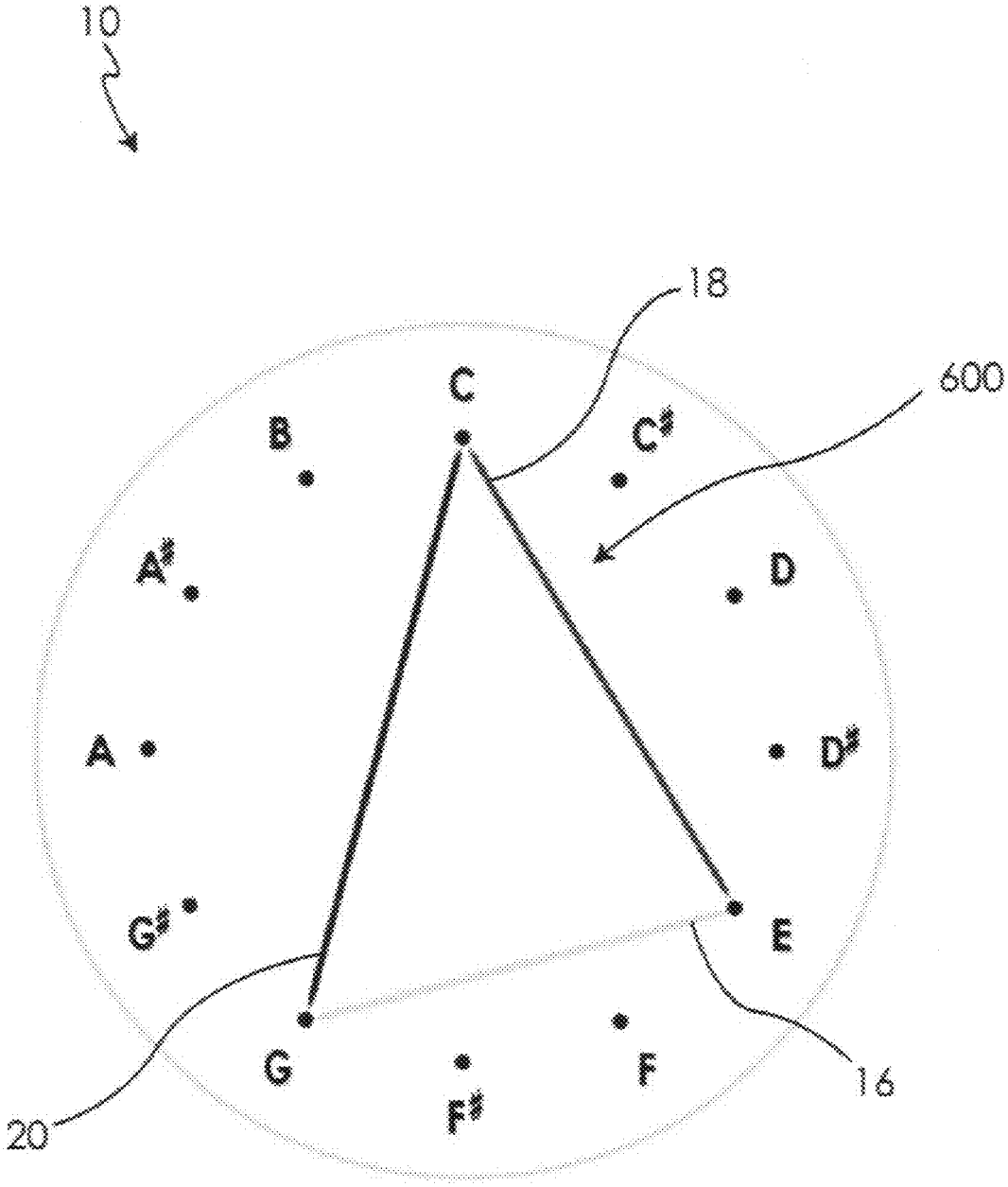
FIG. 6 is a diagram of a twelve-tone circle showing a major triad.

The next generation of MASTER KEY™ diagrams is based upon musical shapes that are built with three notes. In musical terms, three note structures are referred to as triads. There are only four triads in all of diatonic music, and they have the respective names of major, minor, diminished, and augmented. These four, three-note shapes are represented in the MASTER KEY™ diagrams as different sized triangles, each built with various color coded intervals. As shown in FIG. 6, for example, the major triad 600 is built by stacking (in a clockwise direction) a major third 18, a minor third 16, and then a perfect fourth 20. This results in a triangle with three sides in the respective colors of green, yellow, and blue, following the assigned color for each interval in the triad. The diagrams for the remaining triads (minor, diminished, and augmented) follow a similar approach.

Figure 7:
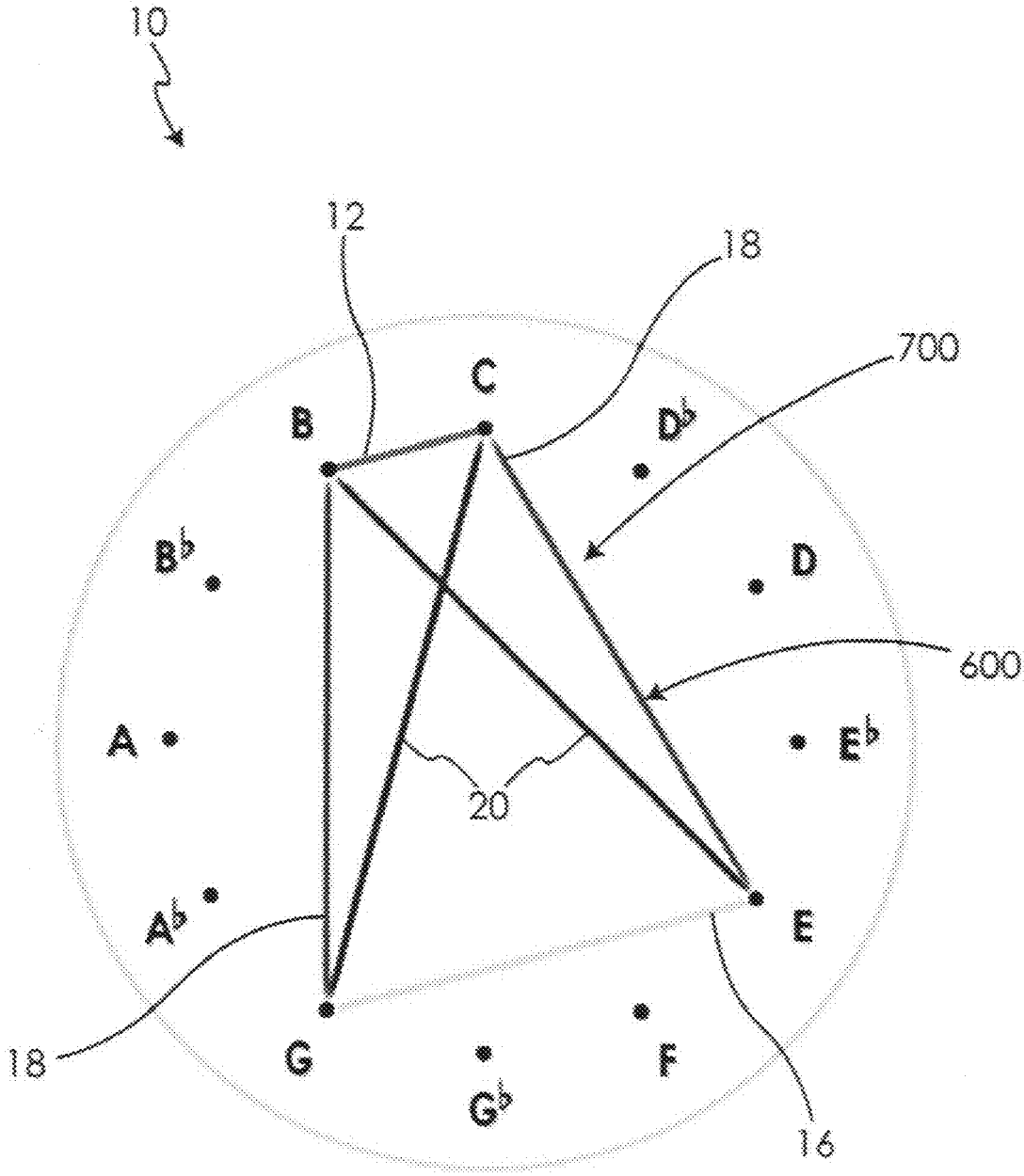
FIG. 7 is a diagram of a twelve-tone circle showing a major seventh chord.

The next group of MASTER KEY™ diagrams are developed from four notes at a time. Four note chords, in music, are referred to as seventh chords, and there are nine types of seventh chords. FIG. 7 shows the diagram of the first seventh chord, the major seventh chord 700, which is created by stacking the following intervals (as always, in a clockwise manner): a major third 18, a minor third 16, another major third 18, and a half step 12. The above description illustrates the outer shell of the major seventh chord 700 (a four-sided polyhedron); however, general observation will quickly reveal a new pair of 'internal' intervals, which haven't been seen in previous diagrams (in this instance, two perfect fourths 20). The eight remaining types of seventh chords can likewise be mapped on the MASTER KEY™ circle using this method.

Figure 8:
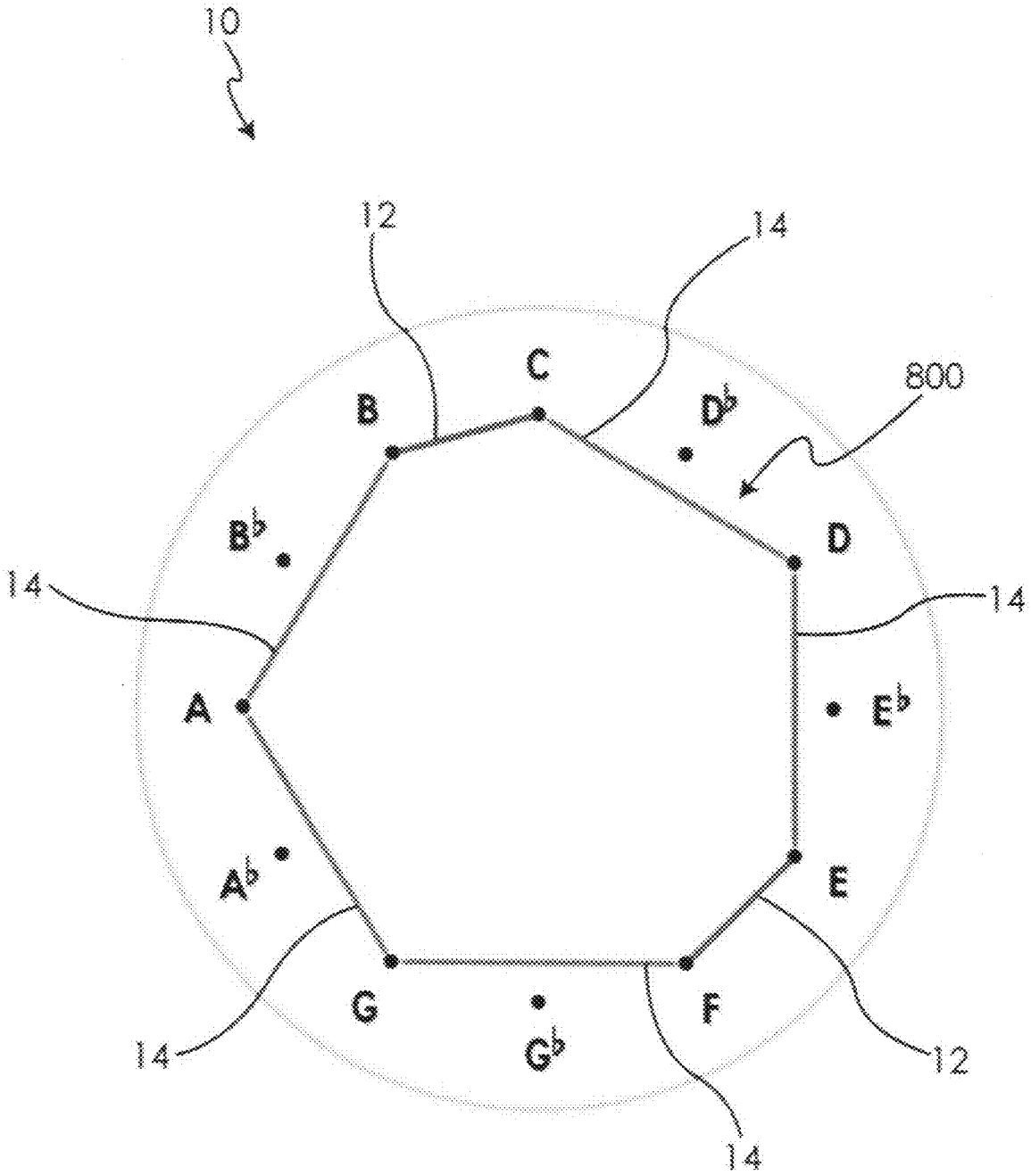
FIG. 8 is a diagram of a twelve-tone circle showing a major scale.

Every musical structure that has been presented thus far in the MASTER KEY™ system, aside from the six basic intervals, has come directly out of three main scales. Again, the three main scales are as follows: the Major Scale, the Harmonic-Minor Scale, and the Melodic-Minor Scale. The major scale is the most common of the three main scales and is heard virtually every time music is played or listened to in the western world. As shown in FIG. 8 and indicated generally at 800, the MASTER KEY™ diagram clearly shows the major scale's 800 makeup and its naturally lopsided nature. Starting at the top of the circle 10, one travels clockwise around the scale's outer shell. The following pattern of intervals is then encountered: whole step 14, whole step 14, half step 12, whole step 14, whole step 14, whole step 14, half step 12. The most important aspect of each scale diagram is, without a doubt, the diagram's outer 'shell.' Therefore, the various internal intervals in the scale's interior are not shown. Since we started at point 10.12, or C, the scale 800 is the C major scale. Other major scales may be created by starting at one of the other notes on the twelve-tone circle 10. This same method can be used to create diagrams for the harmonic minor and melodic minor scales as well.

Figure 9:
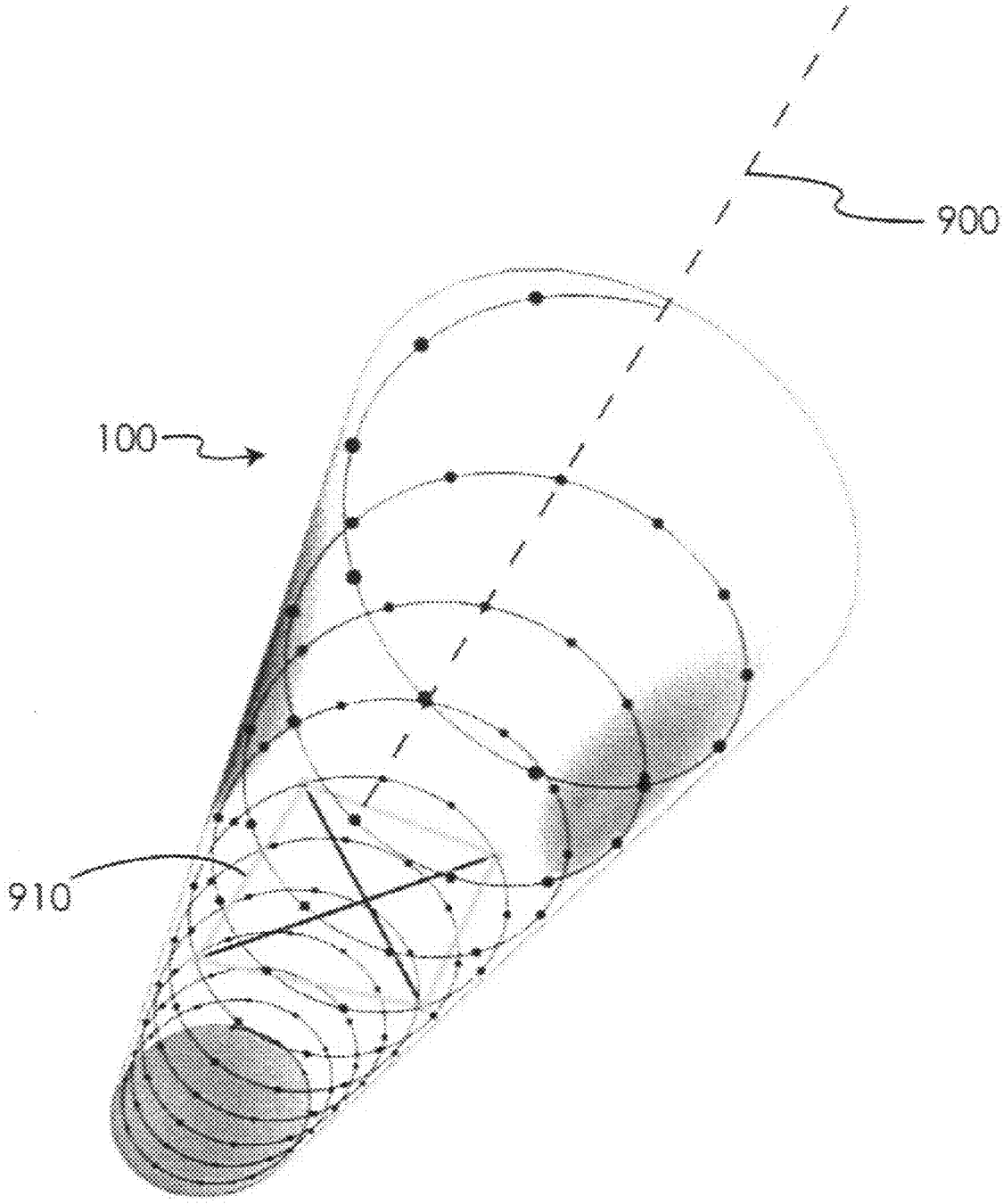
FIGS. 9-10 are diagrams of a helix showing a B diminished seventh chord.
Figure 10:
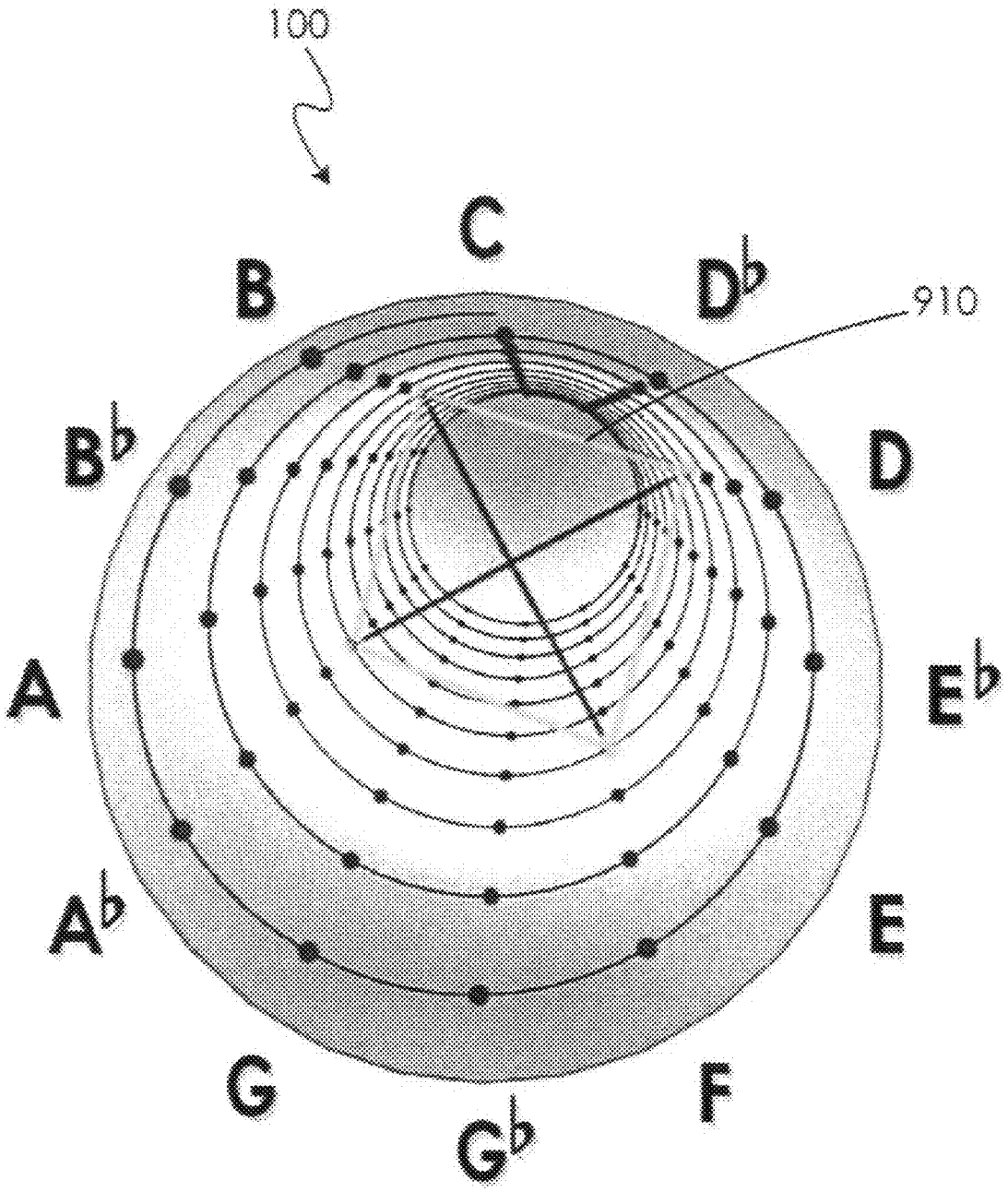

The previously described diagrams have been shown in two dimensions; however, music is not a circle as much as it is a helix. Every twelfth note (an octave) is one helix turn higher or lower than the preceding level. What this means is that music can be viewed not only as a circle but as something that will look very much like a DNA helix, specifically, a helix of approximately ten and one-half turns (i.e. octaves). There are only a small number of helix turns in the complete spectrum of audible sound; from the lowest auditory sound to the highest auditory sound. By using a helix instead of a circle, not only can the relative pitch difference between the notes be discerned, but the absolute pitch of the notes can be seen as well. For example, FIG. 9 shows a helix 100 about an axis 900 in a perspective view with a chord 910 (a fully diminished seventh chord in this case) placed within. In FIG. 10, the perspective has been changed to allow each octave point on consecutive turns of the helix to line up. This makes it possible to use a single set of labels around the helix. The user is then able to see that this is a B fully diminished seventh chord and discern which octave the chord resides in.

Figure 11:
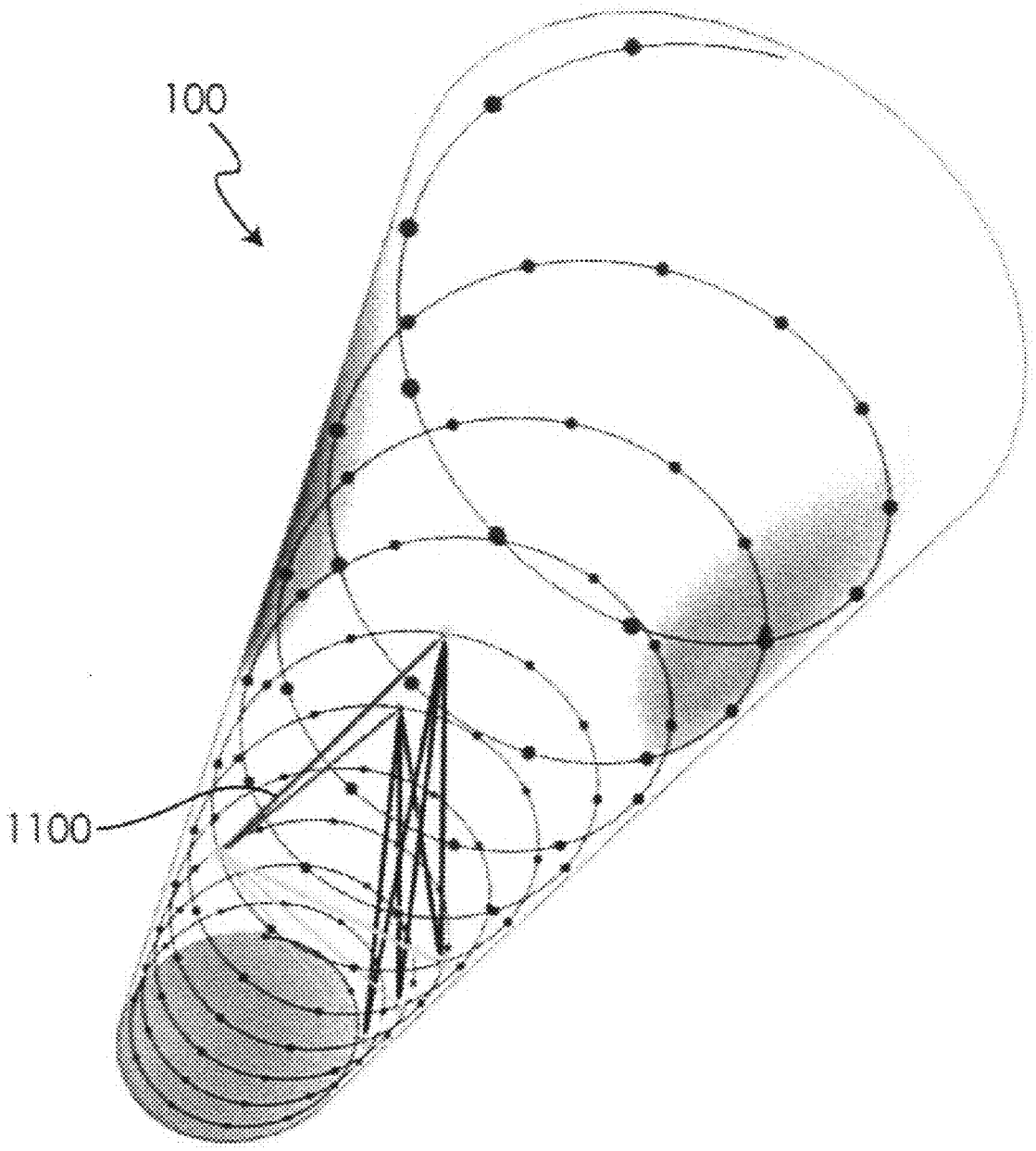
FIG. 11 is a diagram of a helix showing an F minor triad covering three octaves.

The use of the helix becomes even more powerful when a single chord is repeated over multiple octaves. For example, FIG. 11 shows how three F minor triad chords look when played together over three and one-half octaves. In two dimensions, the user will only see one triad, since all three of the triads perfectly overlap on the circle. In the three-dimensional helix, however, the extended scale is visible across all three octaves.

The above described MASTER KEY™ system provides a method for understanding the tonal information within musical compositions. Another method, however, is needed to deal with the rhythmic information, that is, the duration of each of the notes and relative time therebetween. Such rhythmic visualization methods are described in U.S. Utility patent application Ser. No. 12/023,375 entitled "Device and Method for Visualizing Musical Rhythmic Structures" filed Jan. 31, 2008 which is also hereby incorporated by reference.

In addition to being flawed in relation to tonal expression, traditional sheet music also has shortcomings with regards to rhythmic information. This becomes especially problematic for percussion instruments that, while tuned to a general frequency range, primarily contribute to the rhythmic structure of music. For example, traditional staff notation 1250, as shown in the upper portion of FIG. 12, uses notes 1254 of basically the same shape (an oval) for all of the drums in a modern drum kit and a single shape 1256 (an 'x' shape) for all of the cymbals. What is needed is a method that more intuitively conveys the character of individual rhythmic instruments and the underlying rhythmic structures present in a given composition.

Figure 12:
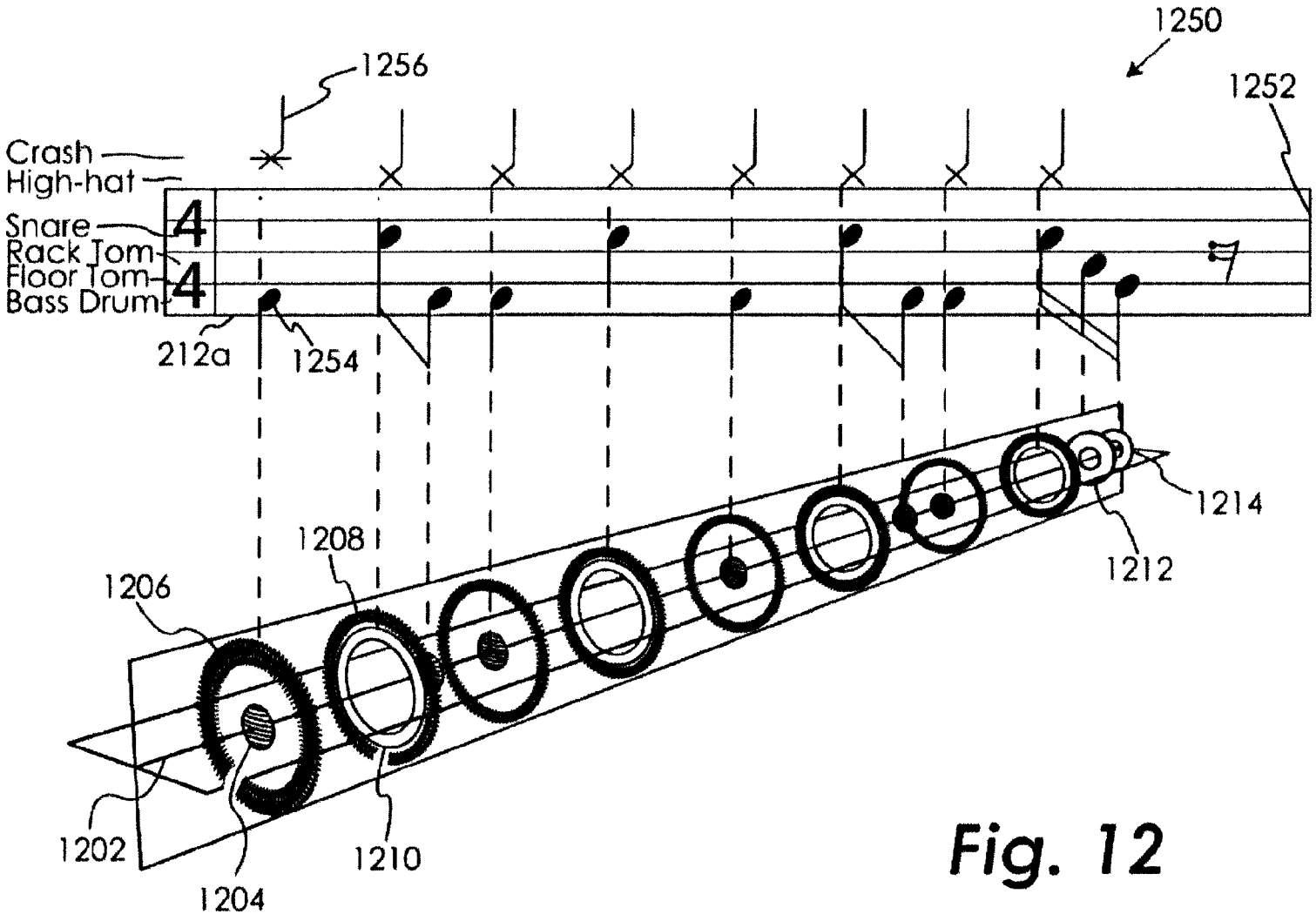
FIG. 12 is a perspective view of the visual representation of percussive music according to one embodiment shown with associated standard notation for the same percussive music.

The lower portion of FIG. 12 shows one embodiment of the disclosed method which utilizes spheroids 1204 and toroids 1206, 1208, 1210, 1212 and 1214 of various shapes and sizes in three dimensions placed along a time line 1202 to represent the various rhythmic components of a particular musical composition. The lowest frequencies or lowest instrument in the composition (i.e. the bass drum) will appear as spheroids 1204. As the rhythmical frequencies get higher in range, toroids 1206, 1208, 1210, 1212 and 1214 of various sizes are used to represent the sounded instrument. While the diameter and thicknesses of these spheroids and toroids may be adjustable components that are customizable by the user, the focus will primarily be on making the visualization as "crisply" precise as possible. In general, therefore, as the relative frequency of the sounded instrument increases, the maximum diameter of the spheroid or toroid used to depict the sounding of the instrument also increases. For example, the bass drum is represented by a small spheroid 1204, the floor tom by toroid 1212, the rack tom by toroid 1214, the snare by toroid 1210, the high-hat cymbal by toroid 1208, and the crash cymbal by toroid 1206. Those skilled in the art will recognize that other geometric shapes may be utilized to represent the sounds of the instruments within the scope of the disclosure.

Figure 13:
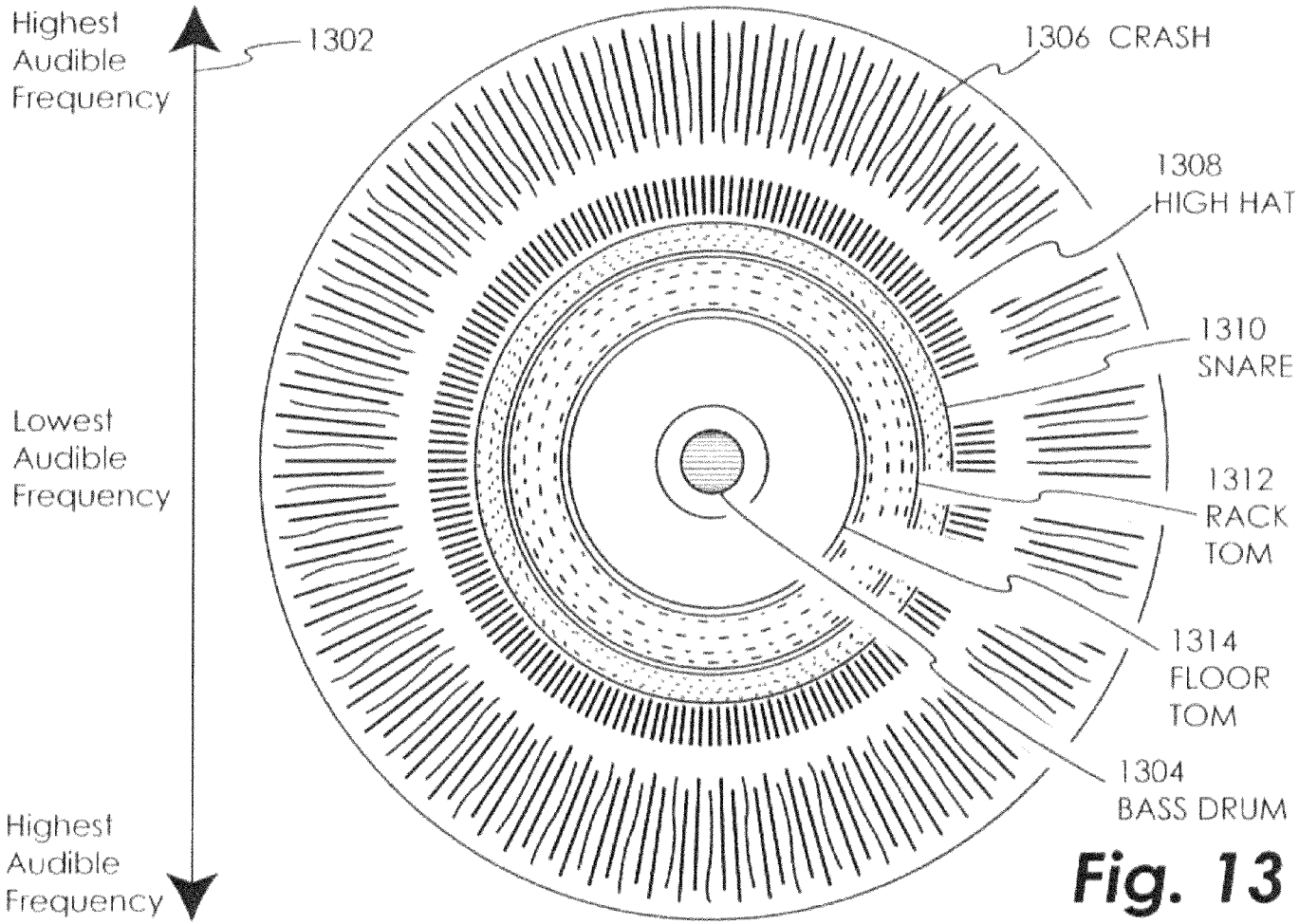
FIG. 13 is a two dimensional view looking along the time line of a visual representation of percussive music at an instant when six percussive instruments are being simultaneously sounded.

FIG. 13 shows another embodiment which utilizes a two-dimensional view looking into the time line 1202. In this embodiment, the spheroids 1204 and toroids 1206, 1208, 1210 and 1212 from FIG. 12 correspond to circles 1304 and rings 1306, 1308, 1310 and 1312, respectively. The lowest frequencies (i.e. the bass drum) will appear as a solid circle 1304 in a hard copy embodiment. Again, as the relative frequency of the sounded instrument increases, the maximum diameter of the circle or ring used to depict the sounding of the instrument also increases, as shown by the scale 1302.

Because cymbals have a higher auditory frequency than drums, cymbal toroids have a resultantly larger diameter than any of the drums. Furthermore, the amorphous sound of a cymbal will, as opposed to the crisp sound of a snare, be visualized as a ring of varying thickness, much like the rings of a planet or a moon. The "splash" of the cymbal can then be animated as a shimmering effect within this toroid. In one embodiment, the shimmering effect can be achieved by randomly varying the thickness of the toroid at different points over the circumference of the toroid during the time period in which the cymbal is being sounded as shown by toroid 1204 and ring 1306 in FIGS. 12 and 13, respectively. It shall be understood by those with skill in the art that other forms of image manipulation may be used to achieve this shimmer effect.

Figure 14:
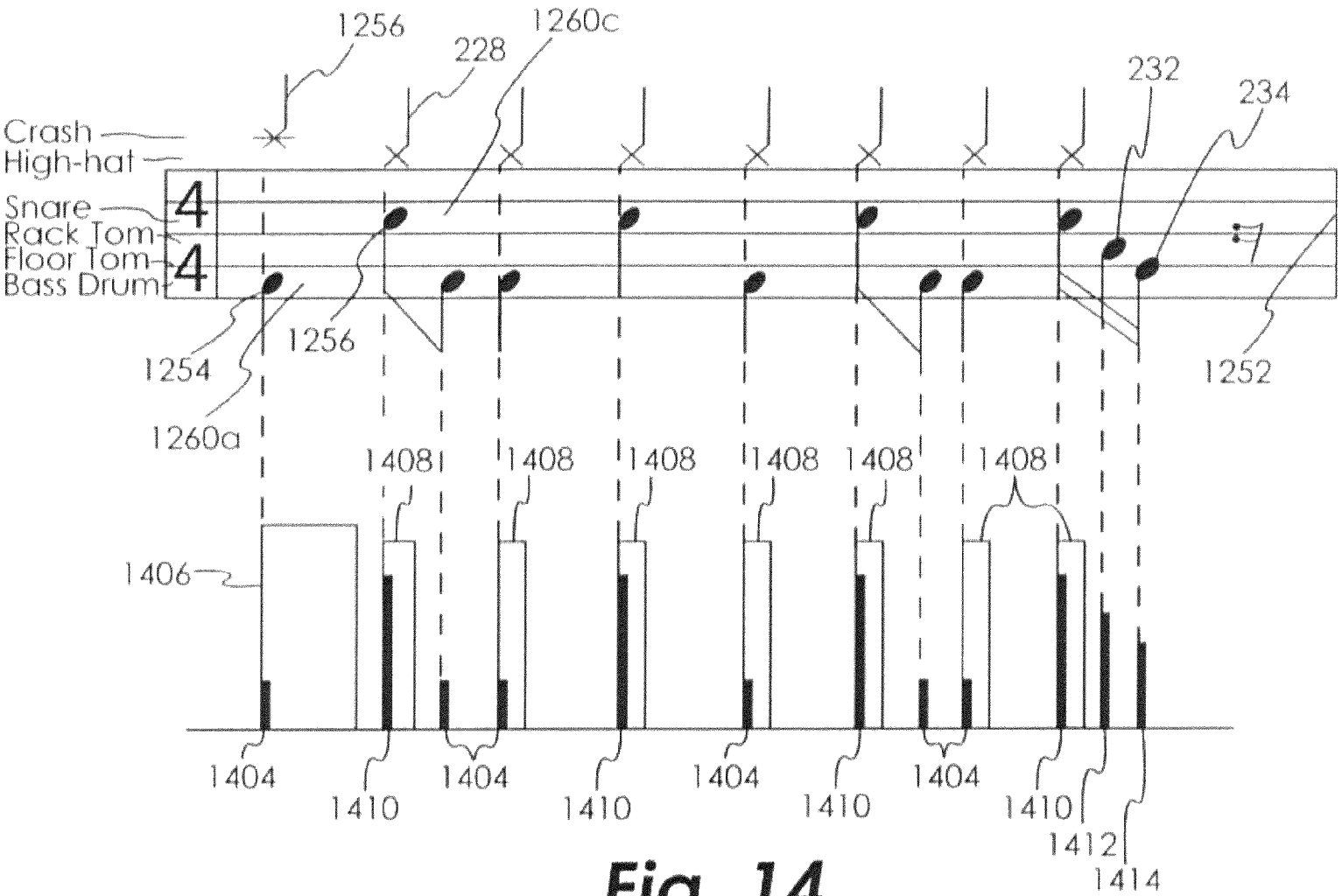
FIG. 14 is a two dimensional view looking perpendicular to the time line of the visual representation of percussive music according to the disclosure associated with standard notation for the same percussive music of FIG. 12.

FIG. 14 shows another embodiment which utilizes a two dimensional view taken perpendicular to the time line 1202. In this view, the previously seen circles, spheroids, rings or toroids turn into bars of various height and thickness. Spheroids 1204 and toroids 1206, 1208, 1210, 1212 and 1214 from FIG. 12 correspond to bars 1404, 1406, 1408, 1410, 1412, and 1414 in FIG. 14. For each instrument, its corresponding bar has a height that relates to the particular space or line in, above, or below the staff on which the musical notation for that instrument is transcribed in standard notation. Additionally, the thickness of the bar for each instrument corresponds with the duration or decay time of the sound played by that instrument. For example, bar 1406 is much wider than bar 1404, demonstrating the difference in duration when a bass drum and a crash cymbal are struck. To enhance the visual effect when multiple instruments are played simultaneously, certain bars may be filled in with color or left open.

The spatial layout of the two dimensional side view shown in FIG. 14 also corresponds to the time at which the instrument is sounded, similar to the manner in which music is displayed in standard notation (to some degree). Thus, the visual representation of rhythm generated by the disclosed system and method can be easily converted to sheet music in standard notation by substituting the various bars (and spaces therebetween) into their corresponding representations in standard notation. For example, bar 1404 (representing the bass drum) will be converted to a note 1254 in the lowest space 1260*a* of staff 1252. Likewise, bar 1410 (representing the snare drum) will be converted to a note 1256 in the second highest space 1260*c* of staff 1252.

The 3-D visualization of this Rhythmical Component as shown, for example, in FIG. 12, results in imagery that appears much like a 'wormhole' or tube. For each composition of music, a finite length tube is created by the system which represents all of the rhythmic structures and relationships within the composition. This finite tube may be displayed to the user in its entirety, much like traditional sheet music. For longer compositions, the tube may be presented to the user in sections to accommodate different size video display screens. To enhance the user's understanding of the particular piece of music, the 3-D 'wormhole' image may incorporate real time animation, creating the visual effect of the user traveling through the tube. In one embodiment, the rhythmic structures appear at the point "nearest" to the user as they occur in real time, and travel towards the "farthest" end of the tube, giving the effect of the user traveling backwards through the tube.

The two-dimensional view of FIG. 13 can also be modified to incorporate a perspective of the user looking straight "into" the three-dimensional tube or tunnel, with the graphical objects made to appear "right in front of" the user and then move away and into the tube, eventually shrinking into a distant center perspective point. It shall be understood that animation settings for any of the views in FIGS. 12-14 can be modified by the user in various embodiments, such as reversing the animation direction or the duration of decay for objects which appear and the fade into the background. This method of rhythm visualization may also incorporate the use of color to distinguish the different rhythmic structures within a composition of music, much like the MASTER KEY™ diagrams use color to distinguish between tonal intervals. For example, each instance of the bass drum being sounded can be represented by a sphere of a given color to help the user visually distinguish it when displayed among shapes representing other instruments.

In other embodiments, each spheroid (whether it appears as such or as a circle or line) and each toroid (whether it appears as such or as a ring, line or bar) representing a beat when displayed on the graphical user interface will have an associated small "flag" or access control button. By mouse-clicking on one of these access controls, or by click-dragging a group of controls, a user will be able to highlight and access a chosen beat or series of beats. With a similar attachment to the Master Key™ music visualization software (available from Musical DNA LLC, Indianapolis, Ind.), it will become very easy for a user to link chosen notes and musical chords with certain beats and create entire musical compositions without the need to write music using standard notation. This will allow access to advanced forms of musical composition and musical interaction for m round the world.

In order to utilize the tonal or rhythm visualization of a piece of music as described above, however, the audio input information must be placed in a format that the visualization algorithm can understand. In the case of an input MIDI file, this can be accomplished quite easily, since the MIDI standard defines certain digital data sets for each particular instrument. It becomes more complicated, however, when raw audio formats are used, such as prerecorded albums or MP3 files. The challenge with these types of audio inputs is to separate the individual instruments and notes played in an overall mix so that they may be visualized for the user. To accomplish this goal, a method of note extraction will now be described.

Figure 15:
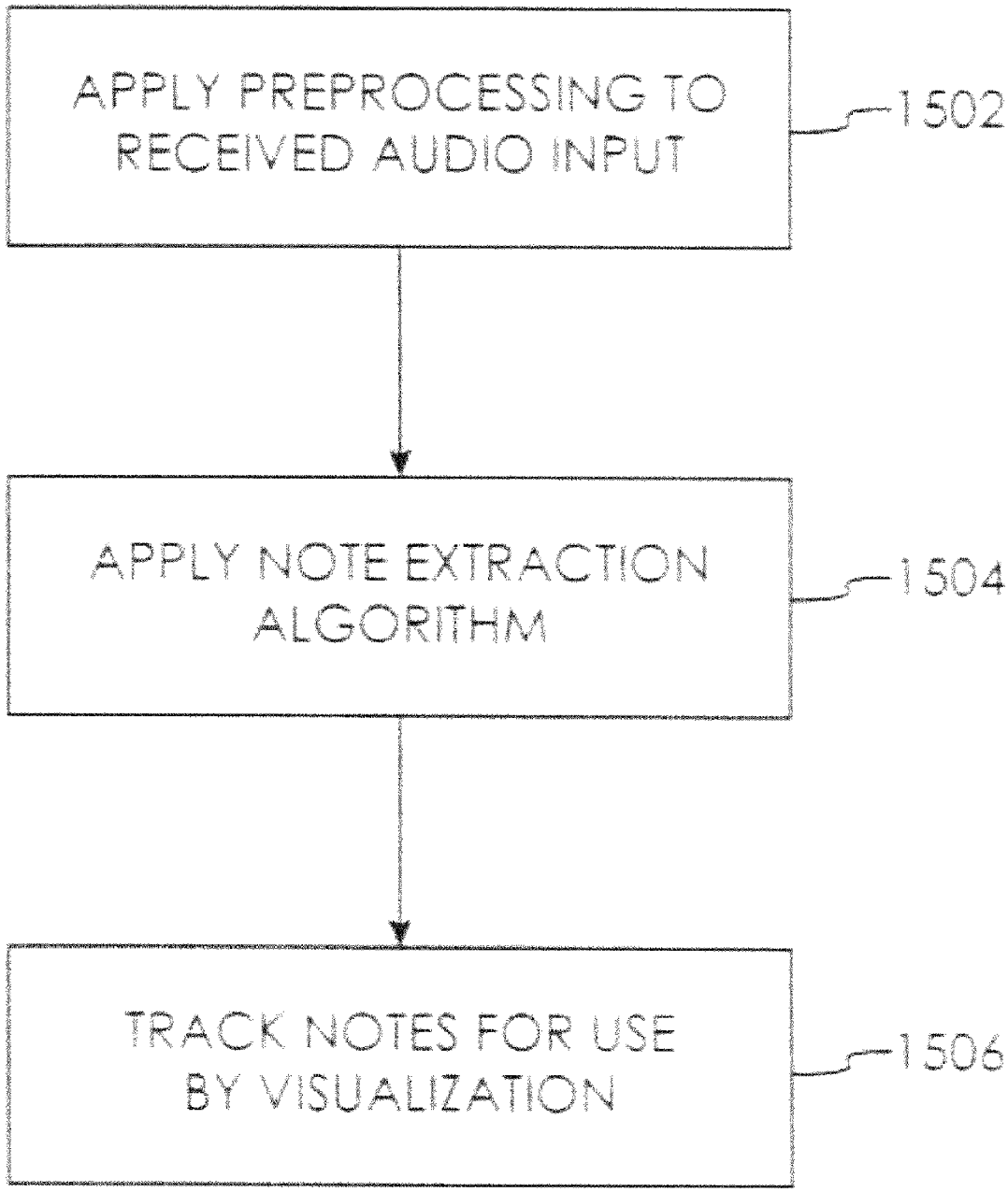
FIG. 15 is a process flow diagram showing a method of visualizing music and sound using note extraction according to one embodiment.

As shown in FIG. 15, the process begins with an input preprocessing step 1502. In this step, the input audio samples (for a given window of time) are run through various equations to arrive at a format which can be evaluated for the presence of certain instruments or notes. In certain embodiments, the input can be preprocessed using a Fast Fourier Transform (FFT). This converts the time-domain samples into the frequency domain, showing how much power exists for each frequency band. In other embodiments, a Discrete Cosine Transform (DCT) may be used. The DCT is similar to the FFT, except that the DCT only uses real numbers. In still further embodiments, the preprocessing stage step 1502 can be achieved using Mel Frequency Cepstral Coefficients. These are found by calculating the FFT of a window of the signal, mapping the log amplitudes from the FFT into the Mel scale, and then taking the DCT of the result. In still further embodiments, Cepstrum processing can be used, which takes the Fourier transform of the decibel spectrum. It shall be understood by those skilled in the art that other types of signal processing may be used to convert the audio input to the frequency domain.

After preprocessing, the signal is ready to be analyzed in a note extraction step 1504. This step consists of analyzing the output data from the preprocessing step 1502 to look for the 'signature' of certain instruments and the individual notes being sounded. For example, if the system detects a strong signal in a certain frequency range, it can then narrow the list of possible instruments which fall in that range based upon the frequency range in which an instrument is able to produce sound. Then the system can look for certain groups of simultaneous harmonic overtones and match that 'signature' with the timbre of a given instrument. The system may also comprise a database for storing known instrument type signatures. The signatures may be based on certain types of instruments, such as a trumpet or a saxophone. In certain embodiments, the signatures may be stored for actual individual instruments, such as a particular Stradivarius violin.

In the case of rhythm instruments, the original time domain information can be analyzed to help further determine which instrument was sounded. For example, if the detected sound is very short in duration, it is more likely to be a drum as opposed to a cymbal. The actual note being played can also be determined by the strongest primary frequency detected. In one embodiment, the system compares the detected signatures to a list of known signatures for various instruments. In other embodiments, the system may learn or adapt as the music progresses. For example, most compositions, particularly in pop music, use only a handful of instruments. If the system detects a low frequency sound on each 'beat' of the song, there is a good chance it is either a bass drum or a bass guitar. As the music continues over time, the system looks for particular differences that were detected in previous beats or measures and uses that information to distinguish later occurrences of those instruments.

In certain embodiments, the system will look for repeating rhythmic patterns in the input signal. Then, when the system recognizes the pattern later in the song, it will first check to see if the instrument signature matches that of the instrument identified with the stored pattern before spending time looking at other possible matches. Since there is a high probability that the same instrument is played in a repeating pattern, this reduces the average amount of processing time required to identify which instrument played the notes. In certain embodiments, when the system recognizes a repeating pattern, such as a bass drum sound on each beat of a song at a fairly constant time interval, it will actively look for each successive occurrence of the bass drum frequency signature at the predicted point in time, as opposed to polling at random intervals to check for new sounds. This enables the system to recognize and extract the bass drum note more quickly, spend less time waiting for the sound to occur, and reduce the required processing power.

In other embodiments, the system will look for a group of notes in succession and 'look back' in the program to see if that group of notes has occurred previously in the program. If so, the system will be able to predict what the notes following the first group of notes of a pattern will be. For example, the system may recognize that a group of four different notes are played in succession as part of the main 'hook' of a pop song. The next time the system encounters the first one or two of the notes, it will then first check to see if the remaining notes are the notes that complete the group. Again, by starting with the most likely candidate in the list of possible matching notes, the average amount of processing time required to perform the note extraction process is decreased.

Other settings, adjustable by the user, can be used to help the system identify the nature of the tonal and rhythmic information input to the system. For example, if the input music is composed solely of drum music, the user can make the proper system selection so the system does not look for anything besides drum sounds, allowing a more detailed and efficient identification. In some cases, these reductions in processing time will enable the system to be implemented using lower cost processors. In other cases, the reductions may allow the processing to occur in real time as the input is received using slower processors that might otherwise require the note extraction to be done after the entire input program material is loaded.

A variety of methods are known in the art to perform the note extraction step 1504. In one embodiment, the Hidden Markov Model can be used, which is a generalized pattern recognition system without many of the drawbacks of competing approaches, such as Neural Networks. In other embodiments, Non-Negative Matrix Factorization can be implemented. This approach analyzes polyphonic musical passages and looks for notes that exhibit a harmonically fixed spectral profile, such as piano notes. In still further embodiments, Fuzzy Logic can be employed to predict which instruments are being sounded. Fuzzy Logic attempts to simulate the adaptation and prediction process which takes place in the human brain.

Once the system determines which instruments are being sounded, the process continues with a note tracking step 1506. Here, the information received from note extraction step 1504 is translated into a digital data format recognizable by the visualization algorithm, such as MIDI. This data is then compiled and includes which particular notes were played by which instruments, when the notes were played, and for how long. In practice, there will be certain sounds which are not recognizable by the system. In certain embodiments, these events are visualized as extra graphics, mostly for entertainment purposes, along with the more precise tonal and rhythmic visualizations according to the disclosed method.

In other embodiments, the system 'reads ahead' for some adjustable time in the input signal and determine what tonal and rhythmic events are coming up. By buffering the information in this way, the system can display additional information about each tonal or rhythmic event when it is visualized on the screen. For example, the system may be able to determine the time signature or even the key signature of the song (and any change during the song) by reading a few beats ahead and analyzing the timing of the detected notes or beats. This is then displayed along with the corresponding visualization.

Figure 16:
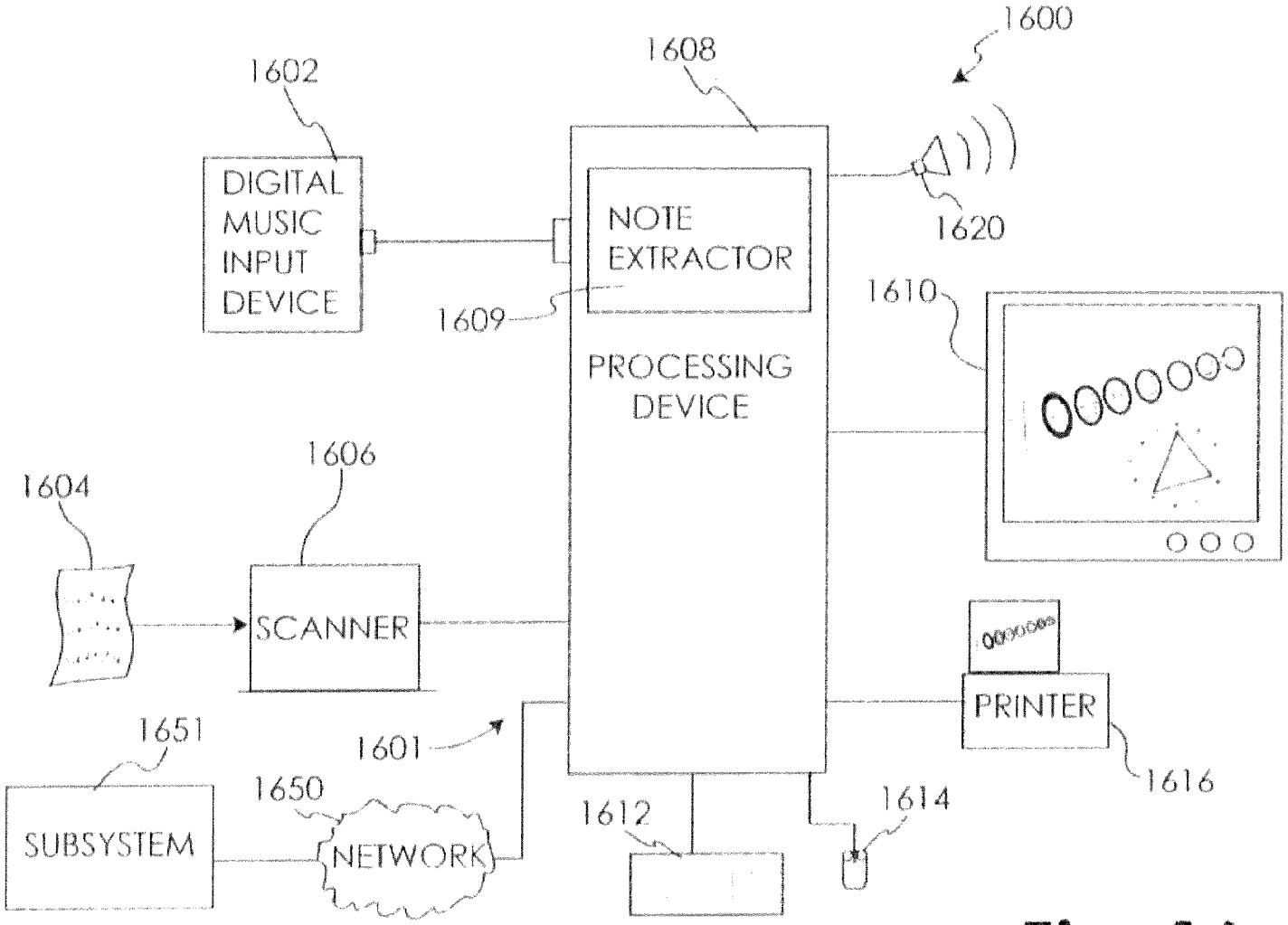
FIG. 16 is a block diagram of a system for generating music visualization using note extraction according to one embodiment.

With reference now to FIG. 16, there is shown a processor-based system for providing visual representation of music and sounds using note extraction, indicated generally at 1600. The system 1600 may include a first subsystem 1601 including a digital music input device 1602, a sheet music input device 1606 for inputting sheet music 1604, a processing device 1608, a display 1610, user input devices such as keyboard 1612 and mouse 1614, a printer device 1616 and one or more speakers 1620. These devices are coupled to allow the input of music or other sounds, and the input of musical notation or other sound notation, into the processing device so that the music or sounds may be produced by the speaker 1620 and the visual representations of the music or sounds may be displayed, printed or manipulated by users.

The digital music input device 1602 may include a digital music player such as an MP3 device or CD player, an analog music player, instrument or device with appropriate interface, transponder and analog-to-digital converter, a digital music file, or an input from a sound mixing board, as well as other input devices and systems. The input audio can be in the form of prerecorded or live music, or even direct MIDI information from a MIDI compliant instrument or device.

The note extractor 1609, as described above, is responsible for separating the individual instruments' tonal and rhythmic information into a format that is recognizable by the visualization algorithm. This functionality may be incorporated into processing device 1608. In other embodiments, the note extractor may exist in a separate hardware module or even be incorporated into digital music input device 1602.

The scanner 1606 may be configured to scan written sheet music 1604 in standard or other notation for input as a digital file into the processing device 1608. Appropriate software running on a processor in the processing device 1608 may convert this digital file into an appropriate digital music file representative of the music notated on the scanned sheet music 1604. Additionally, the user input devices 1612, 1614 may be utilized to interface with music composition or other software running on the processing device 1608 (or on another processor) to generate the appropriate digital music files.

The processing device 1608 may be implemented on a personal computer, a workstation computer, a laptop computer, a palmtop computer, a wireless terminal having computing capabilities (such as a cell phone having a Windows CE or Palm operating system), a game terminal, or the like. It will be apparent to those of ordinary skill in the art that other computer system architectures may also be employed.

In general, such a processing device 1608, when implemented using a computer, comprises a bus for communicating information, a processor coupled with the bus for processing information, a main memory coupled to the bus for storing information and instructions for the processor, a read-only memory coupled to the bus for storing static information and instructions for the processor. The display 1610 is coupled to the bus for displaying information for a computer user and the input devices 1612, 1614 are coupled to the bus for communicating information and command selections to the processor. A mass storage interface for communicating with a data storage device containing digital information may also be included in processing device 1608 as well as a network interface for communicating with a network.

The processor may be any of a wide variety of general purpose processors or microprocessors such as the PENTIUM microprocessor manufactured by Intel Corporation, a POWER PC manufactured by IBM Corporation, a SPARC processor manufactured by Sun Corporation, or the like. It will be apparent to those of ordinary skill in the art, however, that other varieties of processors may also be used in a particular computer system. Display device 1610 may be a liquid crystal device (LCD), a cathode ray tube (CRT), a plasma display, or other suitable display device. The mass storage interface may allow the processor access to the digital information the data storage devices via the bus. The mass storage interface may be a universal serial bus (USB) interface, an integrated drive electronics (IDE) interface, a serial advanced technology attachment (SATA) interface or the like, coupled to the bus for transferring information and instructions. The data storage device may be a conventional hard disk drive, a floppy disk drive, a flash device (such as a jump drive or SD card), an optical drive such as a compact disc (CD) drive, digital versatile disc (DVD) drive, HD DVD drive, BLUE-RAY DVD drive, or another magnetic, solid state, or optical data storage device, along with the associated medium (a floppy disk, a CD-ROM, a DVD, etc.)

In general, the processor retrieves processing instructions and data from the data storage device using the mass storage interface and downloads this information into random access memory for execution. The processor then executes an instruction stream from random access memory or read-only memory. Command selections and information that is input at input devices 1612, 1614 are used to direct the flow of instructions executed by the processor. Equivalent input devices 1614 may also be a pointing device such as a conventional trackball device. The results of this processing execution are then displayed on display device 1610.

The processing device 1608 is configured to generate an output for display on the display 1610 and/or for driving the printer 1616 to print a hardcopy. Preferably, the video output to display 1610 is also a graphical user interface, allowing the user to interact with the displayed information.

The system 1600 may also include one or more subsystems 1651 substantially similar to subsystem 1601 and communicating with subsystem 1601 via a network 1650, such as a LAN, WAN or the internet. Subsystems 1601 and 1651 may be configured to act as a web server, a client or both and will preferably be browser enabled. Thus with system 1600, remote teaching and music exchange may occur between users.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed:

1. A method for visualizing music, comprising the steps of:

(a) placing twelve labels in a pattern of a circle, said twelve labels corresponding to twelve respective notes in an octave, such that moving clockwise or counter-clockwise between adjacent ones of said labels represents a musical half-step;

(b) identifying an occurrence of a first one of the twelve notes;

(c) identifying an occurrence of a second one of the twelve notes;

(d) identifying a first label corresponding to the first note;

(e) identifying a second label corresponding to the second note;

(f) creating a first line connecting the first label and the second label, wherein:

(1) the first line is a first color if the first note and the second note are separated by a half step;

(2) the first line is a second color if the first note and the second note are separated by a whole step;

(3) the first line is a third color if the first note and the second note are separated by a minor third;

(4) the first line is a fourth color if the first note and the second note are separated by a major third;

(5) the first line is a fifth color if the first note and the second note are separated by a perfect fourth; and (6) the first line is a sixth color if the first note and the second note are separated by a tri-tone;

wherein said identifying an occurrence of a first one of the twelve notes step comprises the steps of:

(1) receiving a raw audio input signal;

(2) performing a fast fourier transform analysis on said raw audio input signal to determine a first primary frequency;

(3) determining an occurrence of a first one of the twelve notes based on the first primary frequency; and wherein said identifying an occurrence of a second one of the twelve notes step comprises the steps of:

(1) performing a fast fourier transform analysis on said raw audio input signal to determine a second primary frequency;

(2) determining an occurrence of a second one of the twelve notes based on the second primary frequency.

* * * * *